US006809626B2

(12) United States Patent
Chu et al.

(10) Patent No.: US 6,809,626 B2
(45) Date of Patent: Oct. 26, 2004

(54) OVER-CURRENT PROTECTION DEVICE

(75) Inventors: Edward Fu-Hua Chu, Taipei (TW); David Shau-Chew Wang, Taipei (TW); Yun-Ching Ma, Pingtung (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 10/614,958

(22) Filed: Jul. 8, 2003

(65) Prior Publication Data

US 2004/0022001 A1 Feb. 5, 2004

(30) Foreign Application Priority Data

Jul. 31, 2002 (TW) ..... 91211813 U

(51) Int. Cl.[7] ..... H01H 85/147; H01H 85/06; H01C 7/02

(52) U.S. Cl. ..... 337/167; 337/297; 361/106; 338/22 R; 338/328

(58) Field of Search ..... 337/167, 186, 337/187, 227, 228, 290, 295–297; 361/58, 103, 104, 106; 338/22 R, 22 SD, 312, 314, 254, 328

(56) References Cited

U.S. PATENT DOCUMENTS 5,852,397 A 12/1998 Chan et al.
6,377,467 B1 4/2002 Chu et al.
6,392,528 B1 * 5/2002 Myong ..... 338/22 R
6,576,492 B2 * 6/2003 Chen et al. ..... 438/106
6,593,843 B1 * 7/2003 Becker et al. ..... 338/22 R
6,606,023 B2 * 8/2003 Chiang et al. ..... 338/22 R
6,628,498 B2 * 9/2003 Whitney et al. ..... 361/119
6,640,420 B1 * 11/2003 Hetherton et al. ..... 29/612
6,665,164 B2 * 12/2003 Chu et al. ..... 361/106
6,686,827 B2 * 2/2004 Chen et al. ..... 338/22 R

FOREIGN PATENT DOCUMENTS

JP 2000188207 A * 7/2000 ..... H01C/7/02

* cited by examiner

*Primary Examiner*—Anatoly Vortman
(74) *Attorney, Agent, or Firm*—Seyfarth Shaw LLP

(57) ABSTRACT

An over-current protection device comprises a positive temperature coefficient material layer, an upper electrode foil, a lower electrode foil, a first metal terminal layer, a second metal terminal layer and at least one insulating layer. The upper electrode foil is disposed on the upper surface of the positive temperature coefficient material layer, and the lower electrode foil is disposed on the lower surface of the positive temperature coefficient material layer. The first metal terminal layer electrically connects the upper electrode foil with at least one non-full-circular conductive through hole and at least one full-circular conductive through hole, and the second metal terminal layer electrically connects the lower electrode foil with at least one non-full-circular conductive through hole and at least one full-circular conductive through hole. The insulating layer isolates the upper electrode foil from the second metal terminal layer and the lower electrode foil from the first metal terminal layer.

11 Claims, 8 Drawing Sheets

OVER-CURRENT PROTECTION DEVICE

BACKGROUND OF THE INVENTION

1. Field of the Invention

The present invention relates to an over-current protection device, and more particularly, to an over-current protection device that can provide a uniform and stable conductive strength and reliability.

2. Description of Related Art

As portable electronic devices such as mobile phone, laptop computer, portable video camera and personal digital assistant, etc., are widely used, the importance of the over-current protection device, used to prevent electronic devices from the occurrence of over-current or over-temperature, is increased. Since the positive temperature coefficient (PTC) over-current protection device possesses advantages of reusability being sensitive to temperature variation and, high reliability etc., it is very commonly and widely used in high-density circuit boards and the above-mentioned portable electronic devices.

The PTC over-current protection device uses a positive temperature coefficient conductive material as a current sensor. The resistance of the PTC conductive material is very sensitive to temperature variation, which can be kept extremely low at normal operation so that the circuit can operate normally. However, if an over-current or an over-temperature event occurs, the resistance will simultaneously be increased to a very high resistance state (e.g. above 10,000 ohm.) Therefore, the over-current will be reversely eliminated and the objective to protect the circuit device can be achieved.

FIG. 1 is a schematic diagram of a PTC laminate 10 according to the prior art. The detailed inner structure of the PTC laminate 10 is available in U.S. Pat. No. 6,377,467, entitled "SURFACE MOUNTABLE OVER-CURRENT PROTECTING DEVICE." From the side view, the PTC laminate 10 comprises a PTC material layer 11, an upper electrode foil 13 and a lower electrode foil 14 covering the PTC material layer 11, a first metal layer 15 electrically connecting the upper electrode foil 13, a second metal layer 16 electrically connecting the lower electrode foil 14, a solder mask 18 disposed between the first metal layer 15 and the second metal layer 16, and an insulating layer 17 isolating the upper electrode foil 13 from the second metallic layer 16 and the lower electrode foil 14 from the first metallic layer 15. From the top view, the PTC laminate 10 comprises a plurality of conductive through holes 12 and each conductive through hole 12 is electroplated with conductive material inside. A cutter is used to cut off the conductive through hole 12 along the center to form a half-circular conductive through hole 21, and an packaging process is performed to complete the over-current protection device 20, as shown in FIG. 2.

As the size of the electronic devices shrinks, the size of the traditional over-current protection device also shrinks from 1812 (length×width) and 1210 (length×width) to 1206 and 0805, and even to 0603 and 0402. As the size of the traditional over-current protection device is smaller than 0603, the thickness of the cutter is approximately the same as the diameter of the conductive through hole 12. In this condition, an error on cutting the conductive through hole 12 generally forms an over-current protection device that has a conductive through hole with smaller surface. This will decrease the solderability of the over-current protection device 20 for surface mounting onto a circuit board.

Moreover, the material tension and extensibility of the PTC material layer 11 are both larger than those of the metal material under the high voltage condition, which influences the reliability of the PTC over-current protection device 20 on the conductive through holes.

Since the conventional over-current protection device 20 possesses the above-mentioned defects, it is necessary to provide an effective solution for these defects.

BRIEF DESCRIPTION OF THE INVENTION

The objective of the present invention is to provide an over-current protection device, which can enhance the conductive strength and the reliability.

To this end and to avoid the defects in the prior art, the present invention discloses an over-current protection device, which comprises a positive temperature coefficient material layer, an upper electrode foil, a lower electrode foil, a first metal terminal layer, a second metal terminal layer, and at least one insulating layer. The upper electrode foil is disposed on the upper surface of the positive temperature coefficient material layer, and the lower electrode foil is disposed on the lower surface of the positive temperature coefficient material layer. The first metal terminal layer electrically connects the upper electrode foil with at least one non-full-circular conductive through hole and at least one full-circular conductive through hole, and the second metal terminal layer electrically connects the lower electrode foil with at least one non-full-circular conductive through hole and at least one full-circular conductive through hole. The insulating layer isolates the upper electrode foil from the second metal terminal layer and the lower electrode foil from the first metal terminal layer.

The present invention further discloses an over-current protection device, comprising at least two over-current protection modules, a first metal terminal layer, a second metal terminal layer, and at least one first insulating layer. The at least two over-current protection modules are stacked vertically and are electrically connected in parallel, comprise a positive temperature coefficient material layer, an upper electrode foil and a lower electrode foil. The first metal terminal layer electrically connects the upper electrode foil of the at least two over-current protection modules with at least one non-full-circular conductive through hole and at least one full-circular conductive through hole. The second metal terminal layer electrically connects the lower electrode foil of the at least two over-current protection modules with at least one non-full-circular conductive through hole and at least one full-circular conductive through hole. The insulating layer isolates the second metal terminal layer from the upper electrode foil of the uppermost over-current protection module, the first metal terminal layer from the lower electrode foil of the lowest over-current protection module, and the adjacent over-current protection modules from each other.

BRIEF DESCRIPTION OF THE DRAWINGS

The present invention is described below by way of examples with reference to the accompanying drawings which will make readers easily understand the purpose, technical contents, characteristics and achievement of the present invention, wherein.

DESCRIPTION OF THE PREFERRED EMBODIMENTS

Figures 1, 2:
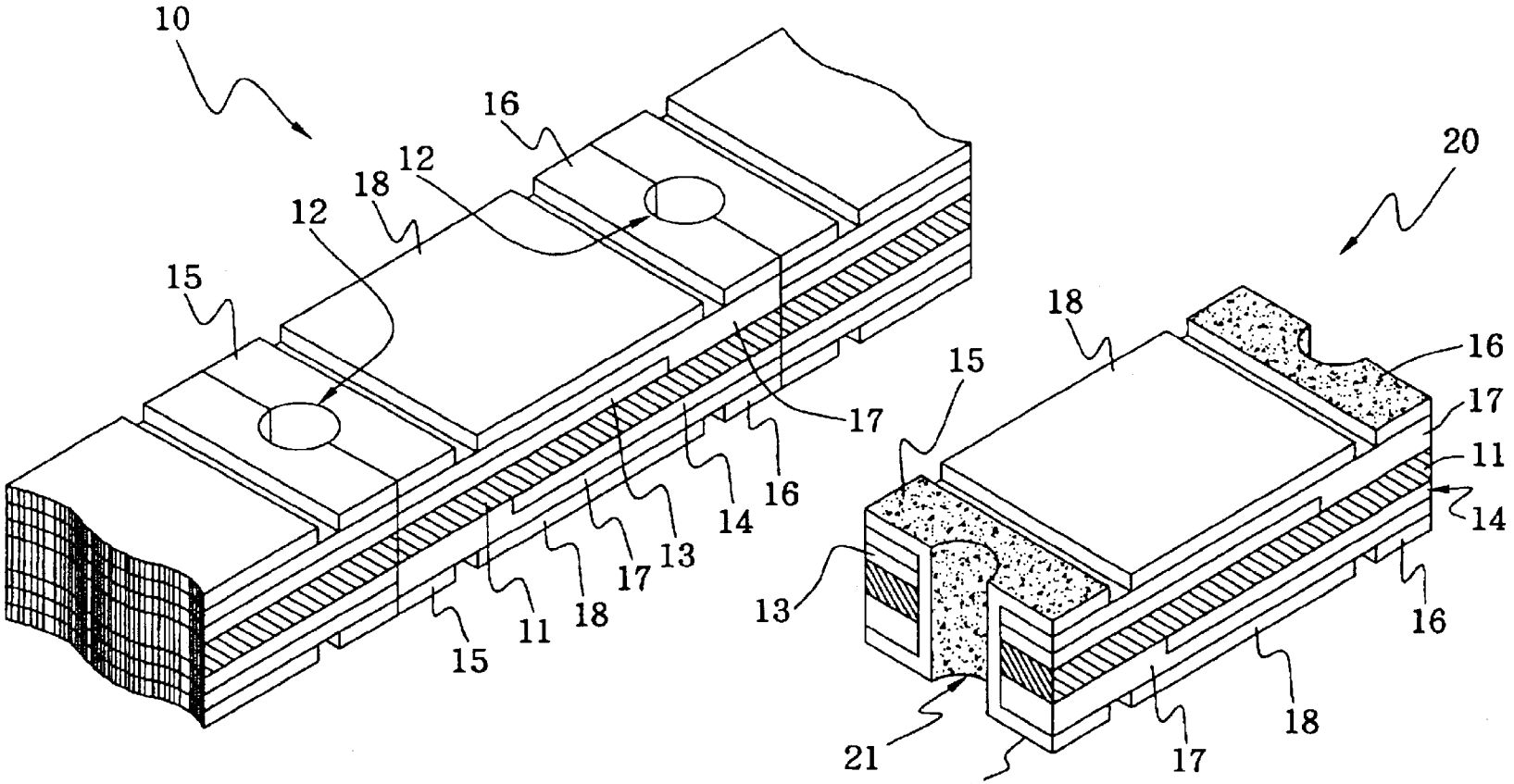
FIG. 2 (Prior Art)
FIG. 1 (Prior Art)
FIG. 1 is a prior art schematic diagram of a PTC laminate.
FIG. 2 is a prior art schematic diagram of a PTC over-current protection device.
Figure 3:
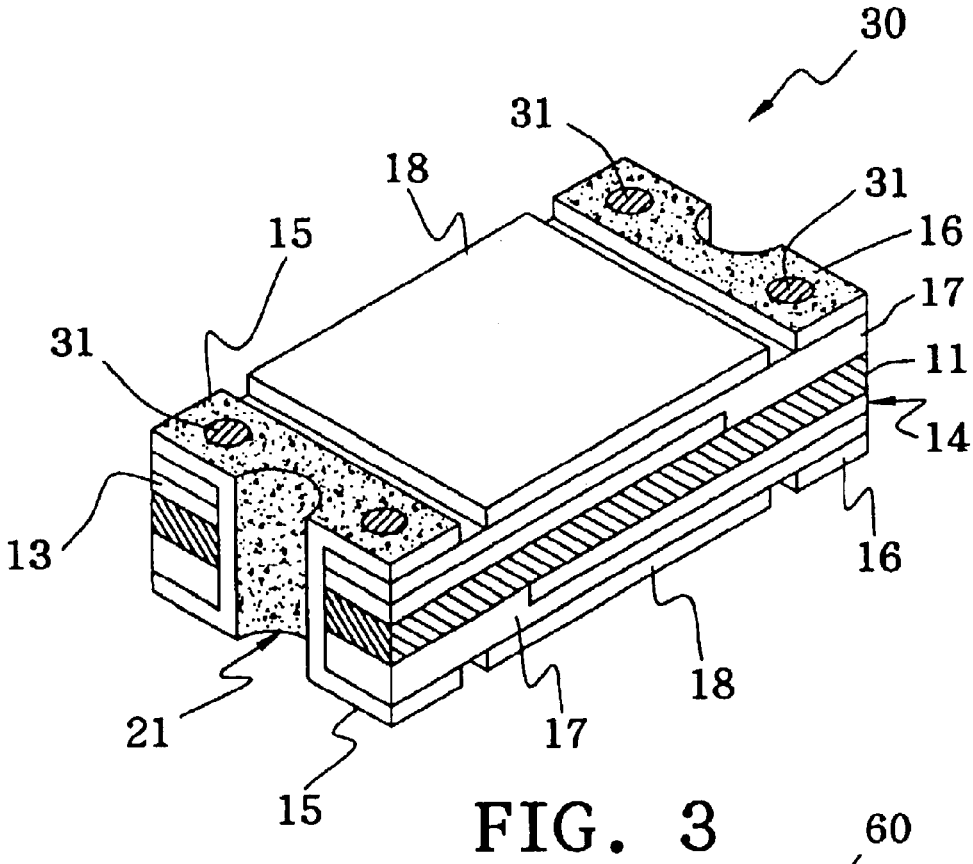
FIG. 3 shows the over-current protection device according to the first embodiment of the present invention.

FIG. 3 shows the first embodiment of an over-current protection device 30 according to the present invention, which is different from the prior art primarily in that, at least one full-circular conductive through hole 31 is embedded on the vertical surfaces of the first metal terminal layer 15 and the second metal terminal 16 of the over-current protection device 30 according to the present invention. Thus, even if the conductive property for the half-circular conductive through hole 21 is not good, the over-current protection device 30 can use the full-circular conductive through hole 31 to enhance the conductive strength and reliability.

Figure 4:
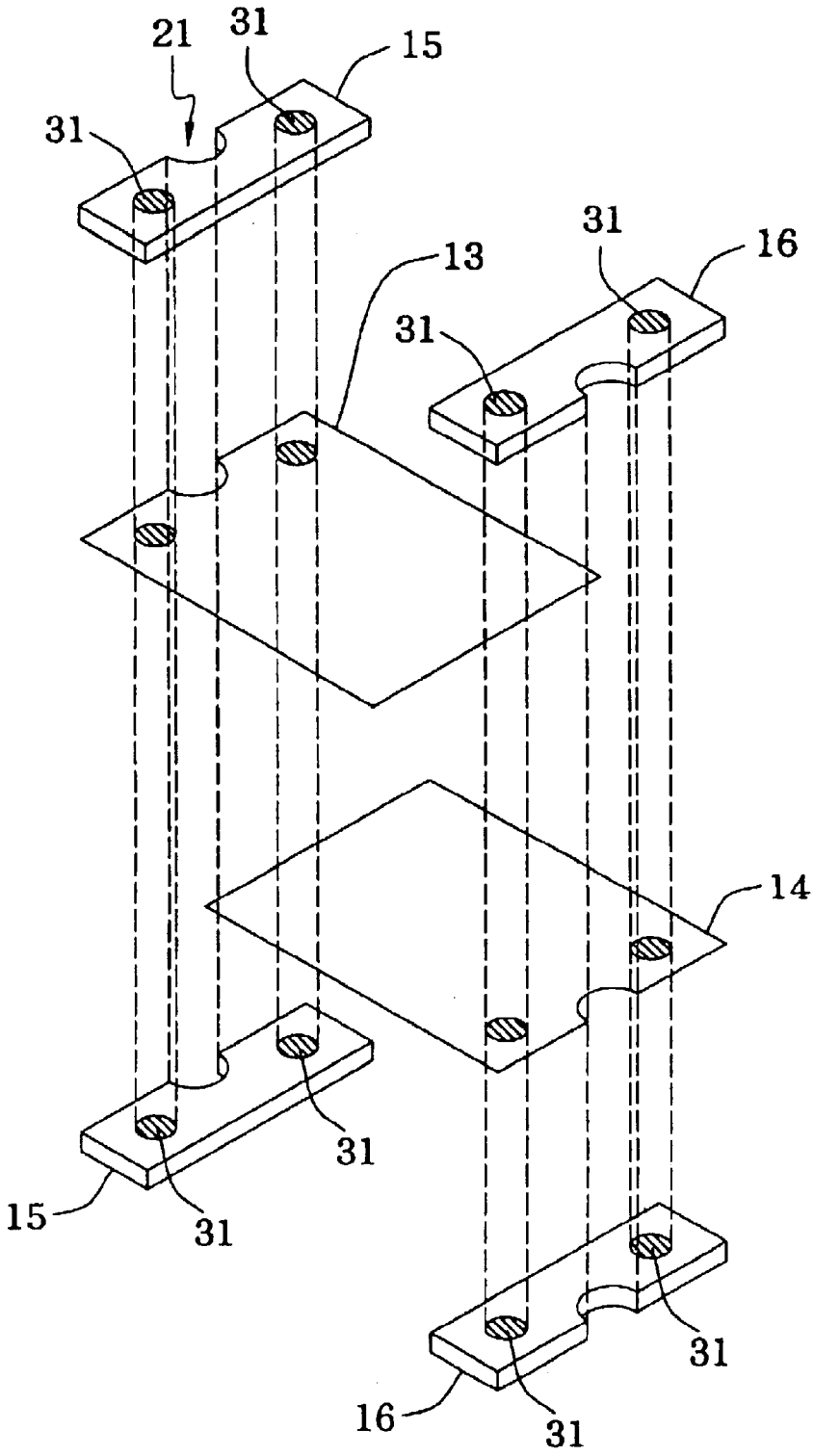
FIG. 4 is schematic diagram showing the connection of the conductive through hole according to the first embodiment of the present invention.

FIG. 4 is schematic diagram showing the connection of the conductive through hole according to the first embodiment of the present invention. The first metal terminal layer 15 can electrically connect the upper electrode foil 13 with the half-circular conductive through hole 21 and the full-circular conductive through hole 31. The second metal terminal layer 16 can electrically connect the lower electrode foil 14 with the half-circular conductive through hole 21 and the full-circular conductive through hole 31. Because the lengths of both the upper electrode foil 13 and the lower electrode foil 14 do not extend to the metal terminal layer on the other ends, the electrical insulation can be maintained between the first metal terminal layer 15 and the lower electrode foil 14, and between the second metal terminal layer 16 and the upper electrode foil 13.

Figure 5:
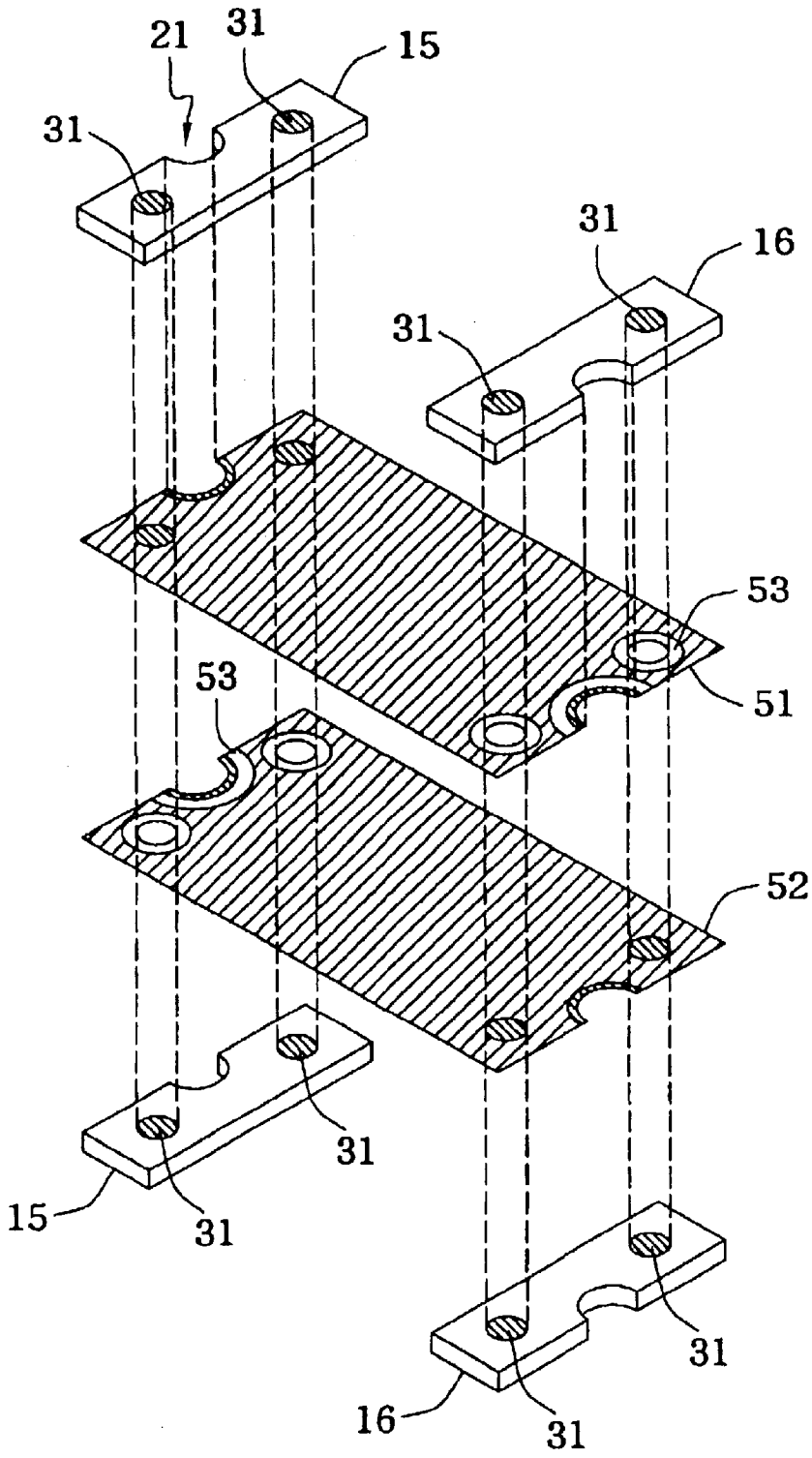
FIG. 5 is schematic diagram showing another connection of the conductive through hole according to the first embodiment of the present invention.

FIG. 5 is schematic diagram showing another connection of the conductive through hole according to the first embodiment of the present invention. The difference between FIG. 4 and FIG. 5 is that the lengths of both the upper electrode foil 51 and the lower electrode foil 52 extend to the metal terminal layer on the other ends. An etching area 53 can be formed on the surface of the upper electrode foil 51 to isolate the upper electrode foil 51 from the half-circular conductive through hole 21 and the full-circular conductive through hole 31 on the second metal terminal layer 16. The etching area 53 on the upper electrode foil 51 is disposed around the region which corresponds to the half-circular conductive through hole 21 and the full-circular conductive through hole 31 on the second metal terminal layer 16. Similarly, an etching area 53 can be also formed on the surface of the lower electrode foil 52 to isolate the upper electrode foil 52 from the half-circular conductive through hole 21 and the full-circular conductive through hole 31 on the first metal terminal layer 15. The etching area 53 on the lower electrode foil 52 is disposed around region corresponding to the half-circular conductive through hole 21 and the full-circular conductive through hole 31 on the first metal terminal layer 15.

Figure 6:
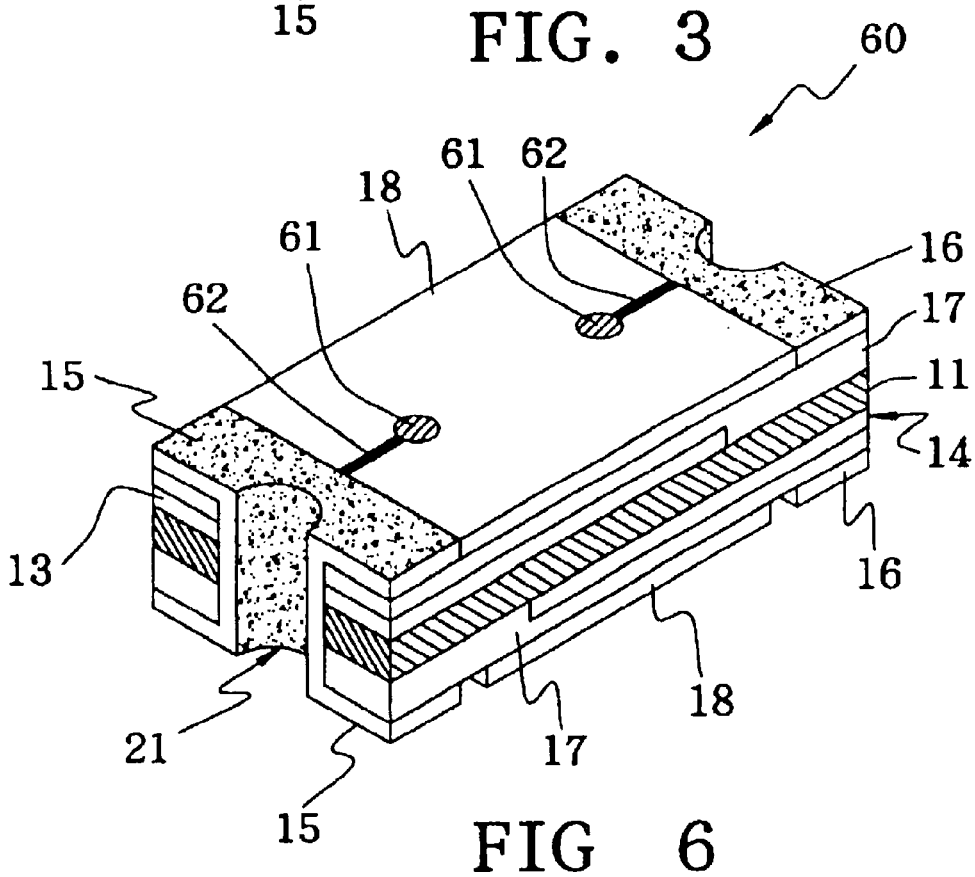
FIG. 6 shows the second embodiment of the over-current protection device according to the present invention.

FIG. 6 shows the second embodiment of an over-current protection device according to the present invention, which is different from FIG. 3 in that the full-circular conductive through hole 61 is not located in the first metal terminal layer 15 or the second metal terminal layer 16, but in the solder mask 18. Since the surface of the first metal terminal layer 15 and the second metal terminal layer 16 are too small to form the full-circular conductive through hole 61 with an even larger area, the full-circular conductive through hole 61 is positioned in the solder mask 18 of the over-current protection device 60 so that the full-circular conductive through hole 61 can be formed with larger surface. The full-circular conductive through hole 61 connects the first metal terminal layer 15 and the second metal terminal layer 16 with a metallic lead 62, for example a copper lead.

Figure 7:
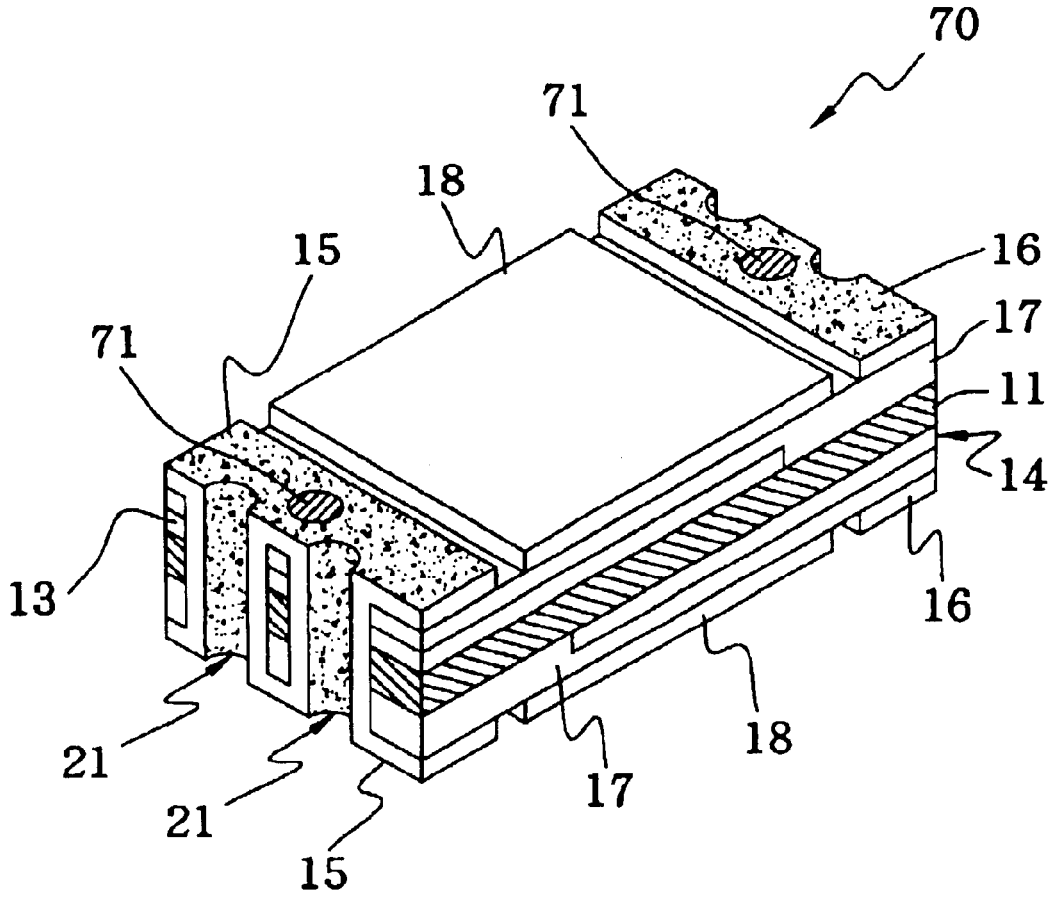
FIG. 7 shows the third embodiment of the over-current protection device according to the present invention.

FIG. 7 shows the third embodiment of an over-current protection device 70 according to the present invention, which is different from FIG. 3 in that the over-current protection device 70 comprises two half-circular conductive through holes 21 and one full-circular conductive through hole 71. In other words, the spirit of the present invention is to use the half-circular conductive through hole 21 and the full-circular conductive through hole 71 to enhance the conductive strength and reliability. The designer can rearrange the location and number for the half-circular conductive through hole 21 and the full-circular conductive through hole 71.

Figure 8:
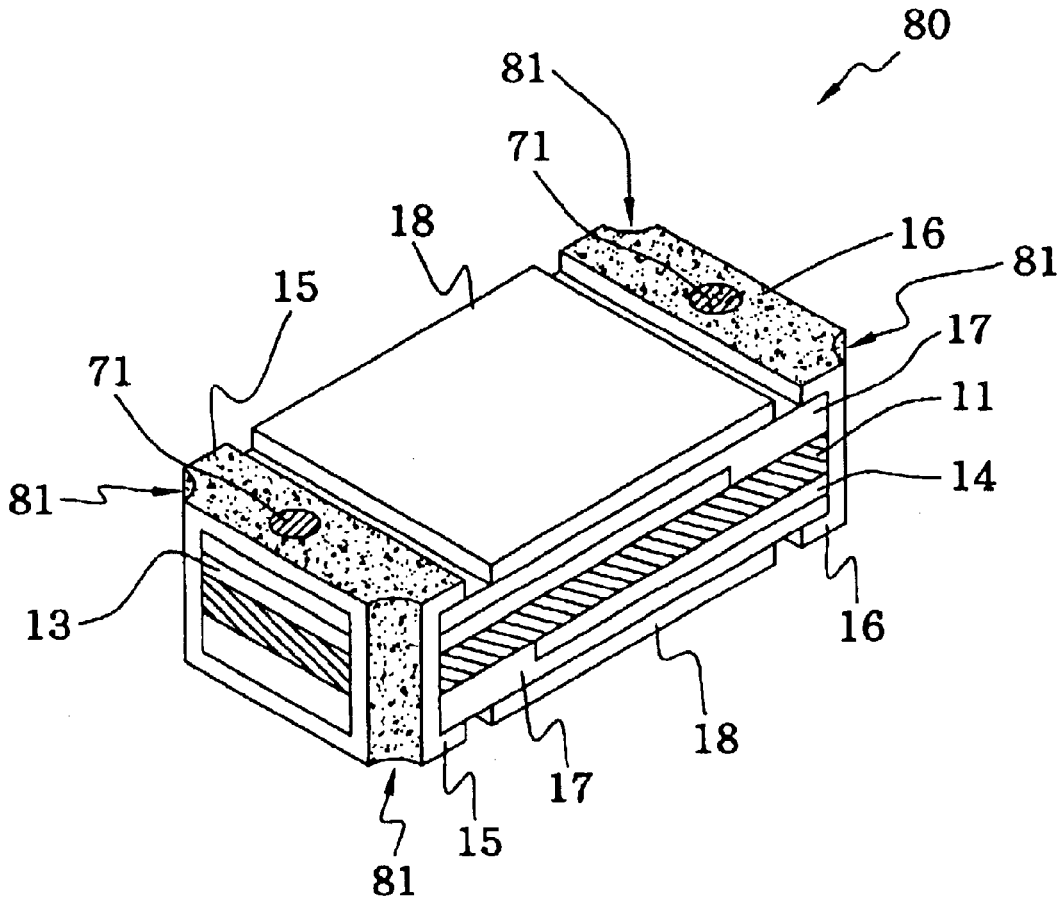
FIG. 8 shows the fourth embodiment of the over-current protection device according to the present invention.

FIG. 8 shows the fourth embodiment of the over-current protection device according to the present invention. The over-current protection device 80 is characterized in that quarter-circular conductive through holes 81 are located at four corners of the over-current protection device 80. The quarter-circular conductive through holes 81 can be formed by suitably arranging the locations of the conductive through holes on the PTC laminate and cutting in horizontal and vertical directions with a cutter.

Figure 9:
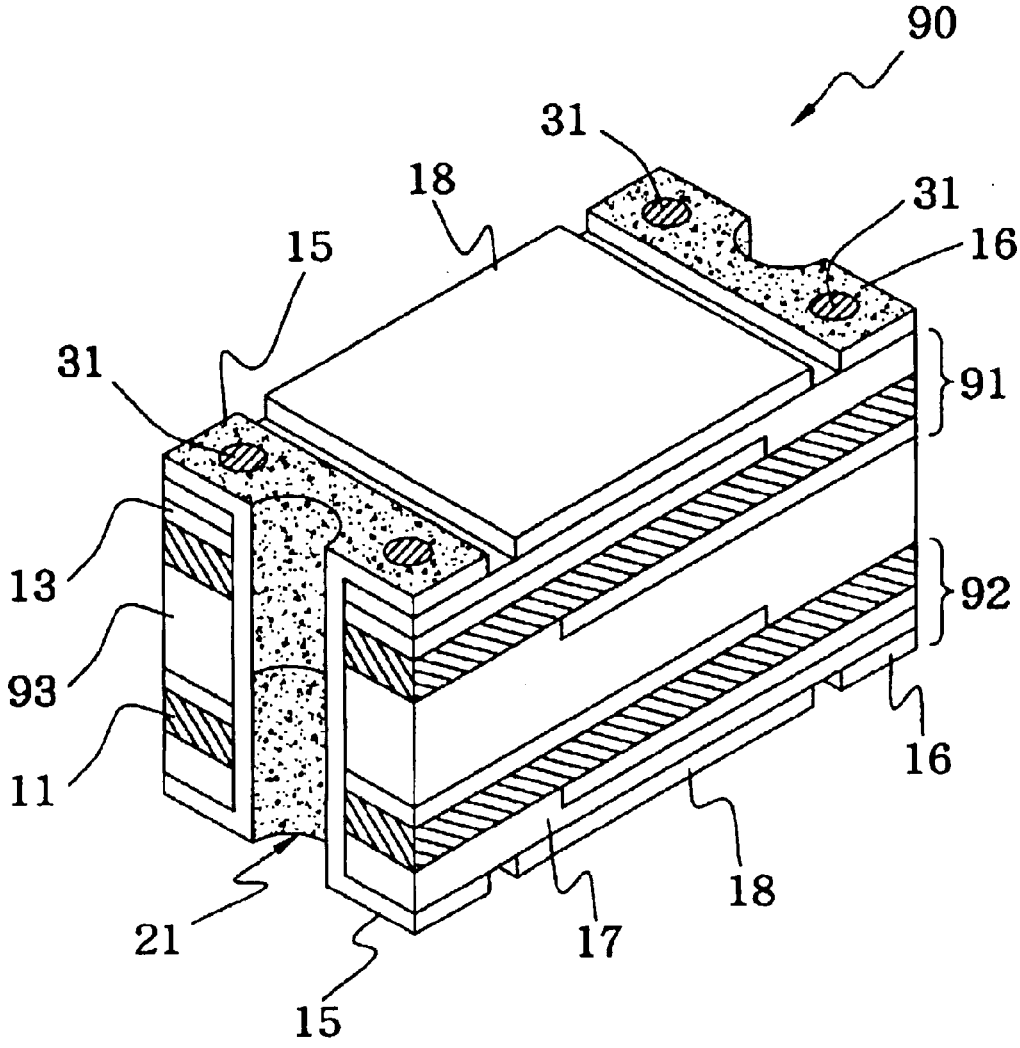
FIG. 9 shows the fifth embodiment of the over-current protection device according to the present invention.

FIG. 9 shows the fifth embodiment of the over-current protection device according to the present invention. The over-current protection device 90 is characterized in that at least two over-current protection modules 91, 92 stacked vertically and electrically connected in parallel to each other are disposed between the first metal terminal layer 15 and the second metal terminal layer 16 to reduce the device resistance and the power consumption. A second insulating layer 93 is disposed between the upper over-current protection module 91 and the lower over-current protection module 92. The insulating layer 93 is made of prepreg (PP, including epoxy resin and glass fiber) to provide the insulation and maintain the hardness above a certain level.

Figure 10:
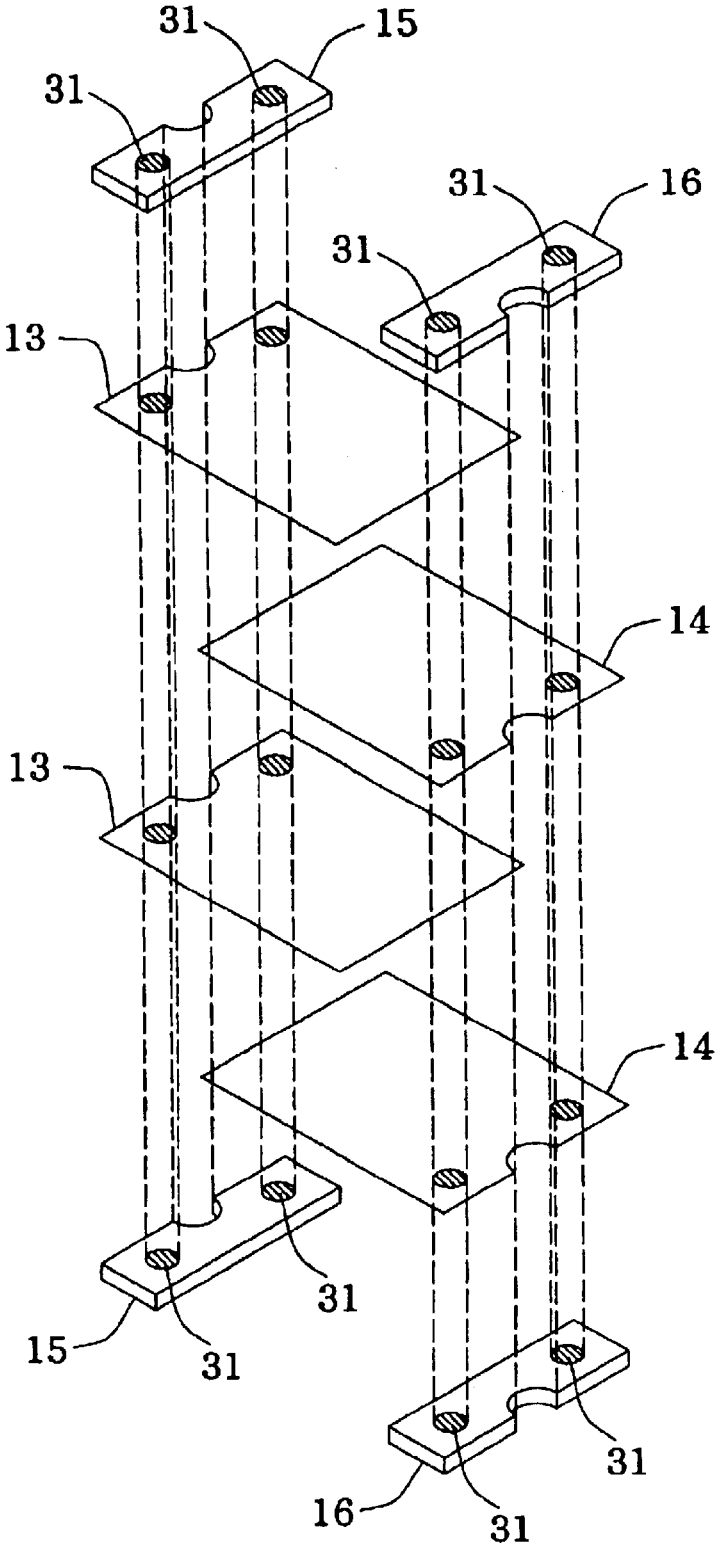
FIG. 10 is schematic diagram showing the connection of the conductive through hole according to the fifth embodiment of the present invention.

FIG. 10 is a schematic diagram showing the connection of the conductive through hole according to the fifth embodiment of the present invention. The first metal terminal layer 15 can electrically connect the upper electrode foil 13 of the upper over-current protection module 91 and the upper electrode foil 13 of the lower over-current protection module 92 by the half-circular conductive through hole 21 and the full-circular conductive through hole 31. The second metal terminal layer 16 can electrically connect the lower electrode foil 14 of the upper over-current protection module 91 and the lower electrode foil 14 of the lower over-current protection module 92 by the half-circular conductive through hole 21 and the full-circular conductive through hole 31. With such electrical connecting design, the upper over-current protection module 91 and the lower over-current protection module 92 are connected to each other in parallel, and disposed between the first metal terminal layer 15 and the second metal terminal layer 16 so that the device resistance and the power consumption is reduced.

The above-described embodiments of the present invention are intended to be illustrative only. Numerous alternative embodiments may be devised by those skilled in the art without departing from the scope of the following claims.

What is claimed is:

1. An over-current protection device, comprising:

a positive temperature coefficient material layer;

an upper electrode foil disposed on the upper surface of the positive temperature coefficient material layer;

a lower electrode foil disposed on the lower surface of the positive temperature coefficient material layer;

a first metal terminal layer electrically connected to the upper electrode foil with at least one non-full-circular conductive through hole and at least one full-circular conductive through hole;

a second metal terminal layer electrically connected to the lower electrode foil with at least one non-full-circular conductive through hole and at least one full-circular conductive through hole; and at least one insulating layer for isolating the upper electrode foil from the second metal terminal layer and the lower electrode foil from the first metal terminal layer.

2. The over-current protection device according to claim 1, further comprising a solder mask disposed between the first metal terminal layer and the second metal terminal layer.

3. The over-current protection device according to claim 1, wherein the full-circular conductive through hole is disposed on the surface of the first metal terminal layer and the second metal terminal layer.

4. The over-current protection device according to claim 2, wherein the full-circular conductive through hole is disposed on the surface of the solder mask and electrically connects first metal terminal layer and the second metal terminal layer by a metallic wire.

5. The over-current protection device according to claim 1, wherein the non-full-circular conductive through hole is a half-circular conductive through hole or a quarter-circular conductive through hole.

6. An over-current protection device, comprising:

at least two over-current protection modules stacked vertically and electrically connected in parallel, each of the over-current protection modules including:

(a) a positive temperature coefficient material layer;

(b) an upper electrode foil disposed on the upper surface of the positive temperature coefficient material layer; and (c) a lower electrode foil disposed on the lower surface of the positive temperature coefficient material layer;

a first metal terminal layer electrically connected to the upper electrode foils of the at least two over-current protection modules with at least one non-full-circular conductive through hole and at least one full-circular conductive through hole;

a second metal terminal layer electrically connected to the lower electrode foils of the at least two over-current protection modules with at least one non-full-circular conductive through hole and at least one full-circular conductive through hole; and at least one first insulating layer for isolating the upper electrode foil of the uppermost over-current protection module from the second metal terminal layer, the lower electrode foil of the lowest over-current protection module from the first metal terminal layer and adjacent over-current protection modules.

7. The over-current protection device according to claim 6, further comprising a solder mask disposed between the first metal terminal layer and the second metal terminal layer.

8. The over-current protection device according to claim 6, wherein the full-circular conductive through hole is disposed on the surface of the first metal terminal layer and the second metal terminal layer.

9. The over-current protection device according to claim 7, wherein the full-circular conductive through hole is disposed on the surface of the solder mask and electrically connects first metal terminal layer and the second metal terminal layer by a metallic wire.

10. The over-current protection device according to claim 6, further comprising a second insulating layer disposed between the upper over-current protection module and the lower over-current protection module, wherein the second insulating layer is made of epoxy resin and glass fiber composite.

11. The over-current protection device according to claim 6, wherein the non-full-circular conductive through hole is a half-circular conductive through hole or a quarter-circular conductive through hole.

* * * * *